US008008591B2

(12) United States Patent
Shi et al.

(10) Patent No.: US 8,008,591 B2
(45) **Date of Patent: *Aug. 30, 2011**

(54) KEY BUTTON STRUCTURE FOR ELECTRONIC DEVICE

(75) Inventors: Zheng Shi, Shenzhen (CN); Chih-Chiang Chang, Taipei Hsien (TW)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 469 days.

This patent is subject to a terminal disclaimer.

(21) Appl. No.: 12/141,233

(22) Filed: Jun. 18, 2008

(65) Prior Publication Data

US 2009/0236207 A1 Sep. 24, 2009

(30) Foreign Application Priority Data

Mar. 21, 2008 (CN) ..... 2008 1 0300657

(51) Int. Cl.
*H01H 3/12* (2006.01)

(52) U.S. Cl. ..... 200/341; 200/302.2

(58) Field of Classification Search ..... 200/341–345, 200/302.1–302.3, 293, 314
See application file for complete search history.

(56) References Cited

U.S. PATENT DOCUMENTS

| | | | | |
|---|---|---|---|---|
| 3,830,991 | A * | 8/1974 | Durocher | 200/86 R |
| 4,170,104 | A * | 10/1979 | Yamagata | 368/289 |
| 4,896,003 | A * | 1/1990 | Hsieh | 200/6 A |
| 5,722,533 | A * | 3/1998 | Gallone | 200/302.2 |
| 5,865,301 | A | 2/1999 | Kawabe et al. | |
| 6,444,928 | B2 * | 9/2002 | Okamoto et al. | 200/5 A |
| 6,516,145 | B2 * | 2/2003 | Uchiyama | 396/25 |
| 6,626,473 | B1 * | 9/2003 | Klein et al. | 200/302.2 |
| 6,963,039 | B1 * | 11/2005 | Weng et al. | 200/302.1 |
| 7,230,196 | B2 * | 6/2007 | Toyama | 200/314 |

FOREIGN PATENT DOCUMENTS

JP 7-314580 A 12/1995

* cited by examiner

*Primary Examiner* — Renee S Luebke
*Assistant Examiner* — Marina Fishman
(74) *Attorney, Agent, or Firm* — Steven M. Reiss

(57) ABSTRACT

A key button structure (10) for using in a portable electronic device (100) is provided. The key button structure (10) include a housing (14) having a joining portion (1428) formed on the outer wall (1422) of the housing (14) and a key body (124) have a mating portion (1245) formed thereon corresponding with the joining portion (1428).

14 Claims, 6 Drawing Sheets

KEY BUTTON STRUCTURE FOR ELECTRONIC DEVICE

BACKGROUND

1. Field of the Invention

This invention relates to key button structures, particularly to key button structures used in a portable electronic device.

2. Description of related art

Many portable electronic devices such as mobile phones, each has a housing with an interior compartment for receiving a printed circuit board (PCB) therein. The mobile phone usually includes a side key assembly on an outer sidewall of the housing, so that user can operate the mobile phone merely by one finger. Typically, the side key assembly includes a key cover and a key cap adhered with the key cover. The key cap is elastic. The key cap can be distorted once an external force exerted thereon, and then restored to its original state by eliminating the external force. The key assembly is disposed in a hole defined on an outer shell of portable electronic device, and a slight gap is defined between the key assembly and the outer shell. If the key assembly is wetted, water and/or vapor may penetrate through the gap into the portable electronic device, thus affecting circuit board of the portable electronic device. In addition, if the dust in the air enters into the portable electronic device through the gap, the performance of the portable electronic device would also be deteriorated.

Therefore, a new key button structure for use in a portable electronic device in order to overcome the above-described shortcomings needs to be provided.

DETAILED DESCRIPTION OF THE EMBODIMENTS

Figure 1:
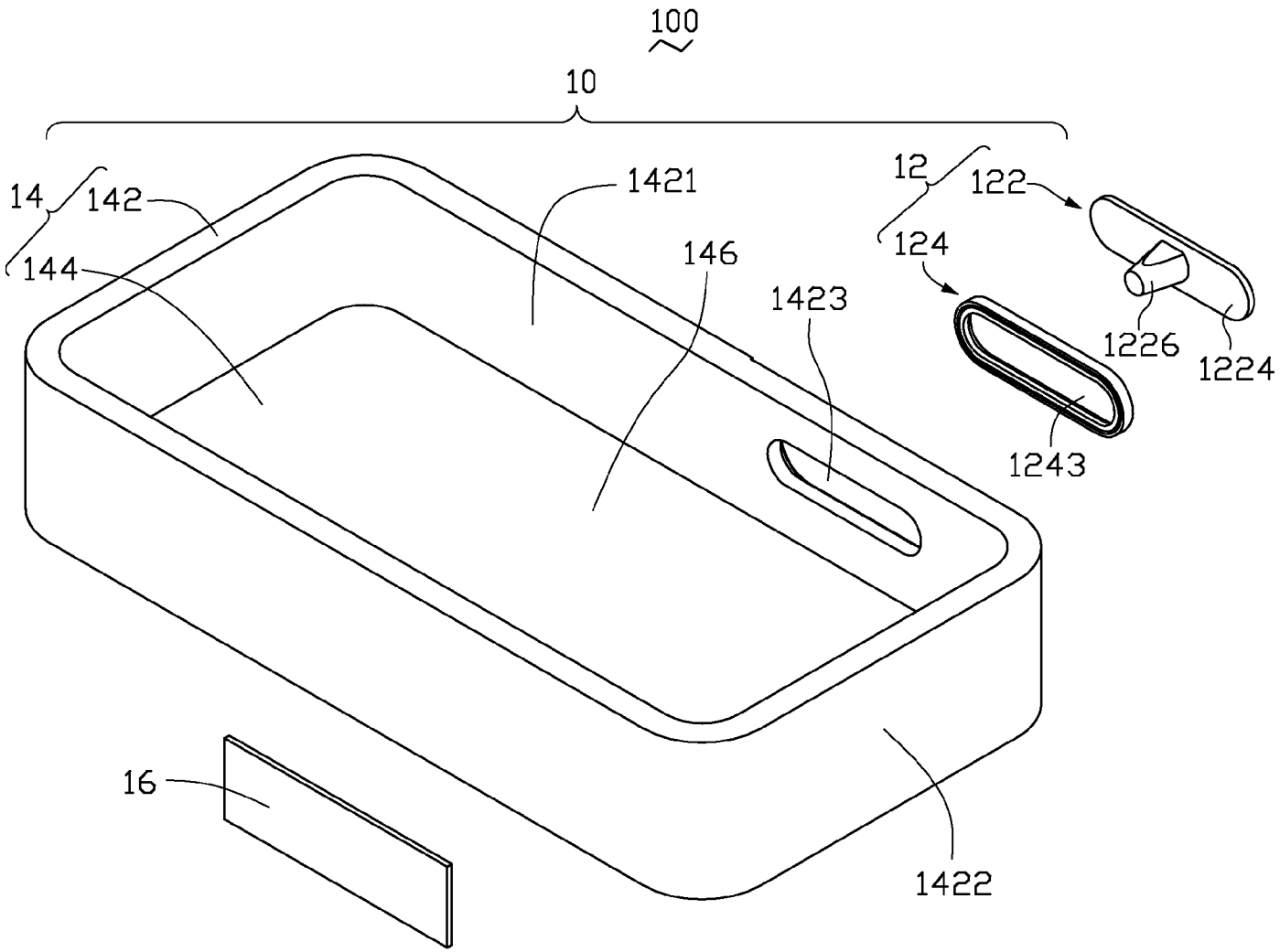
FIG. 1 is an exploded view of a portion of a portable electronic device using a key button structure in accordance with an exemplary embodiment.

FIG. 1 shows a portable electronic device 100 (only a portion of which is shown) having a housing 14 and a key button structure 10. The housing 14 includes a peripheral wall 142 and a bottom panel 144. The peripheral wall 142 and the bottom panel 144 define/enclose a chamber 146 where a circuit board 16 is positioned.

Figure 5:
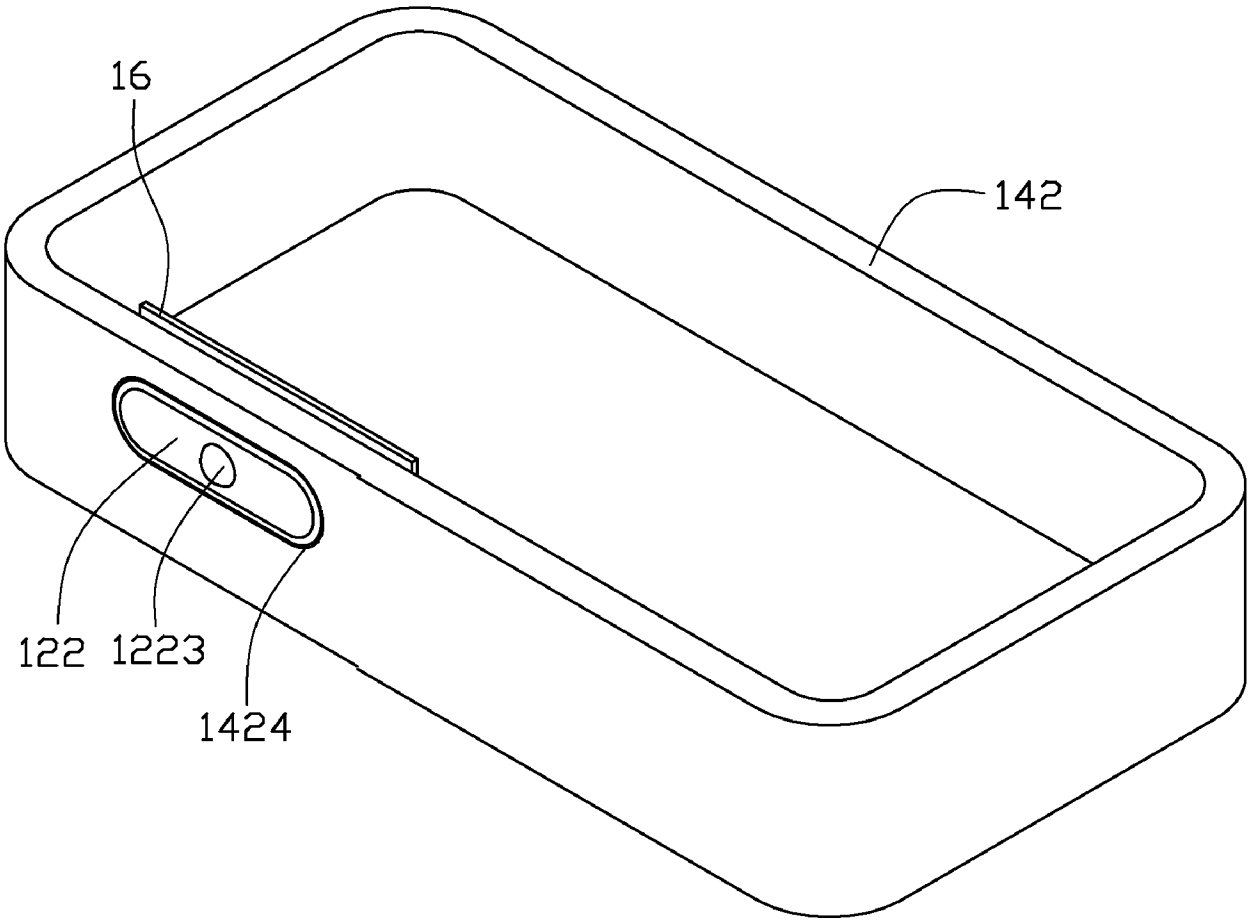
FIG. 5 is an isometric and assembled view of the portable electronic device shown in FIG. 3.
Figure 6:
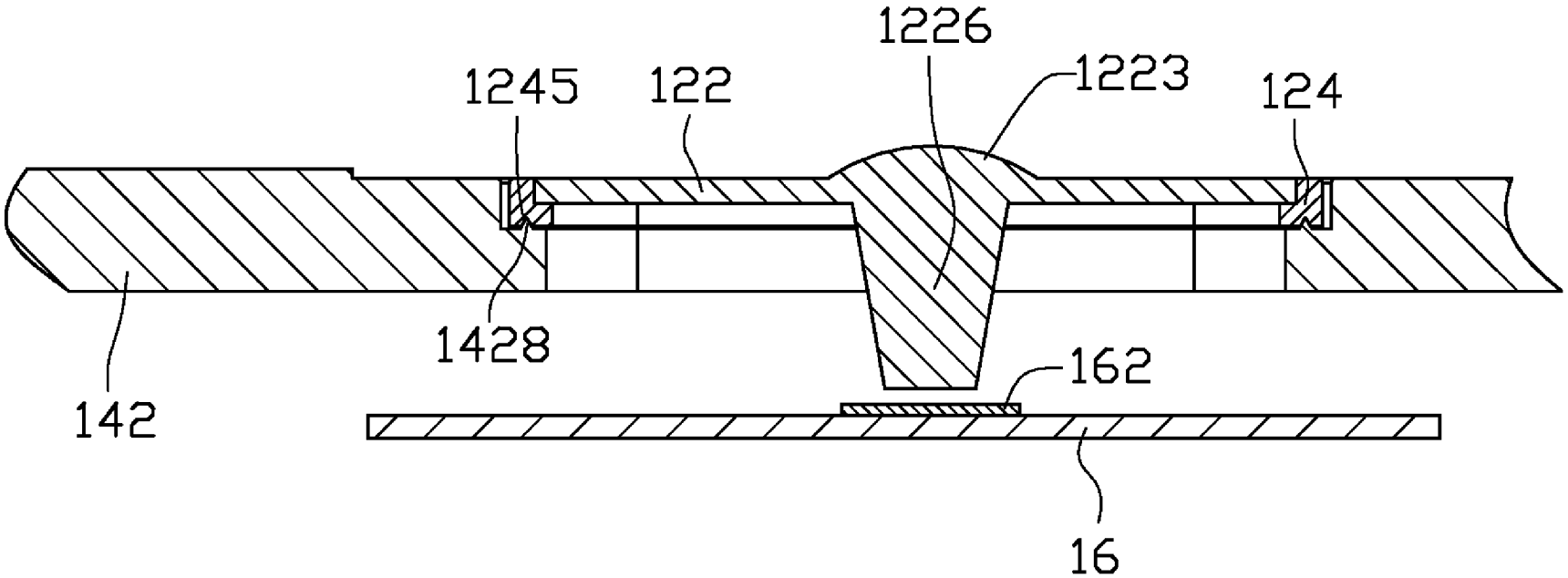
FIG. 6 is a cross sectional view of the portable electronic device shown in FIG. 5.

As shown in FIGS. 5 and 6, the circuit board 16 is associated with the key button structure 10. The key button structure 10 is configured for being pressed to contact the circuit board 16, e.g., to generate an electrical signal.

The key button structure 10 includes a key cap 122 and a key body 124.

The key cap 122 is made of an elastic material (e.g., an elastic rubber material) and can be distorted by an external force. The key cap 122 returns to its original state by releasing the force.

Figure 2:
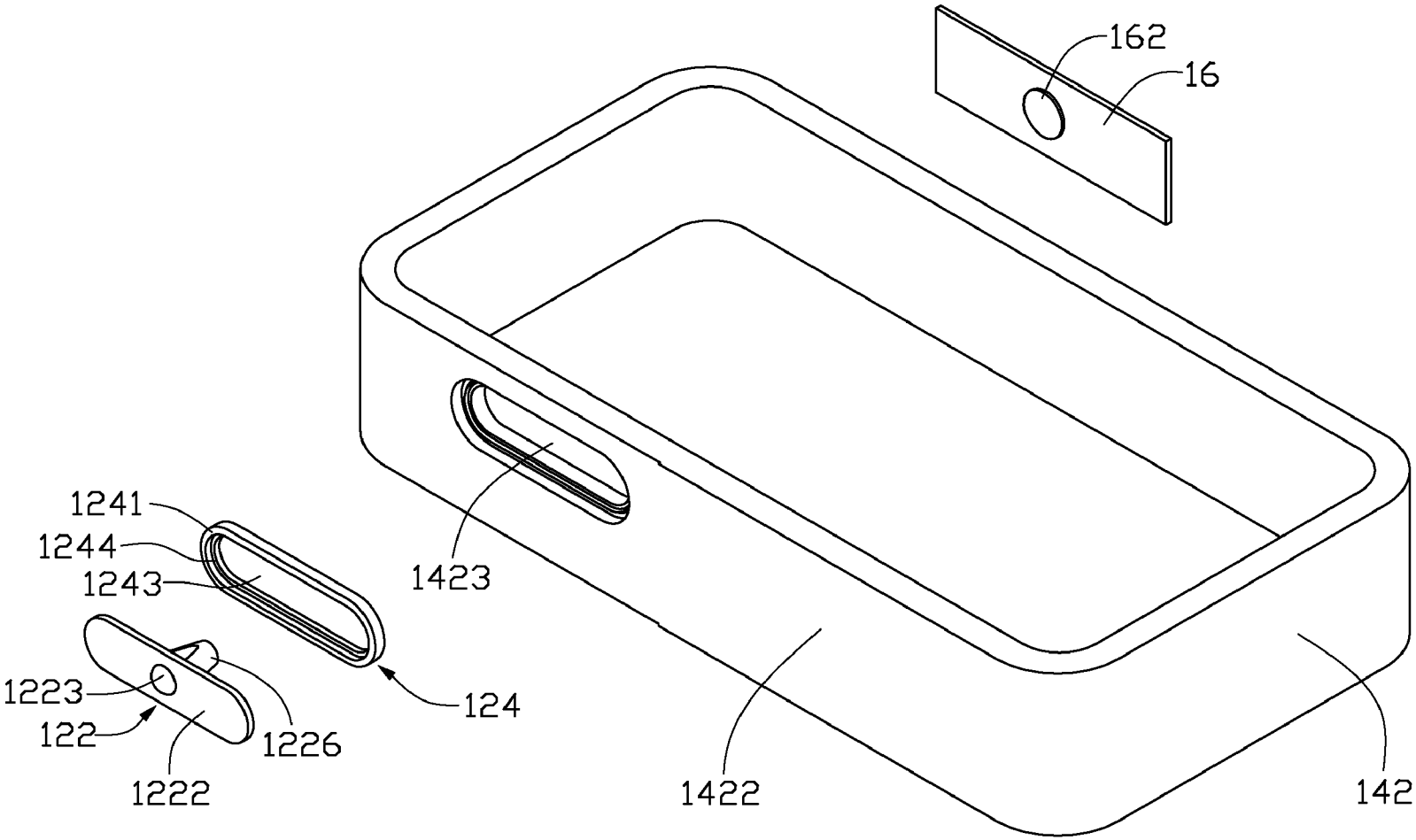
FIG. 2 is an assembled view of the portable electronic device shown in FIG. 1.

Referring to FIG. 2, the key cap 122 has a front surface 1222 and a rear surface 1224. The front surface 1222 is an operating surface of the key button structure 10. Accordingly, a push portion 1223 is formed (e.g., mounted) on the front surface 1222. The key cap 122 has at least one contact 1226 protruding from rear surface 1224. The contact(s) 1226 correspond to and contact signal sensing points 162 of the circuit board 16. The key body 124 is made of a hard material (e.g., a hard plastic material).

The key body 124 has a first wall 1241 and a second wall 1242. The first wall 1241 faces the key cap 122 and is for attaching the key cap 122 to the key body 124. In particular, the key body 124 has a first groove 1244 defined in the first wall 1241. The first groove 1244 surrounds a through aperture 1243. The first groove 1244 has substantially the same size and shape as that of the key cap 122. Accordingly, key cap 122 is press fit into groove 1244.

Figure 3:
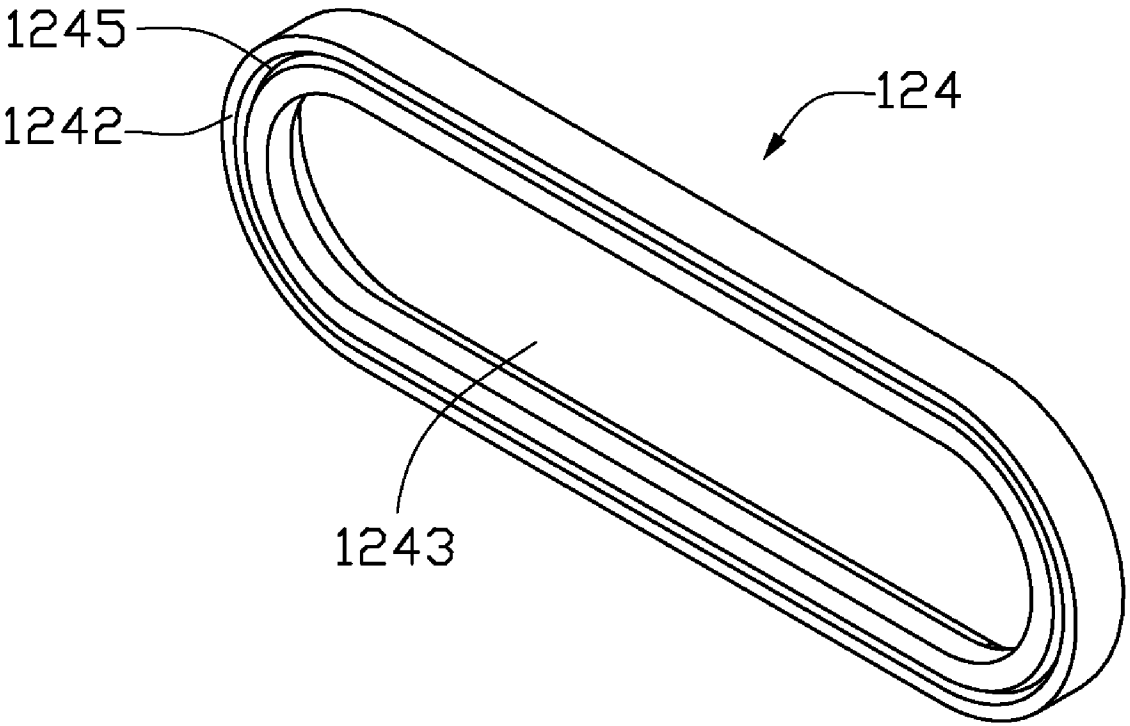
FIG. 3 is an isometric and exploded view of the portable electronic device shown in FIG. 1, showing another aspect thereof.
Figure 4:
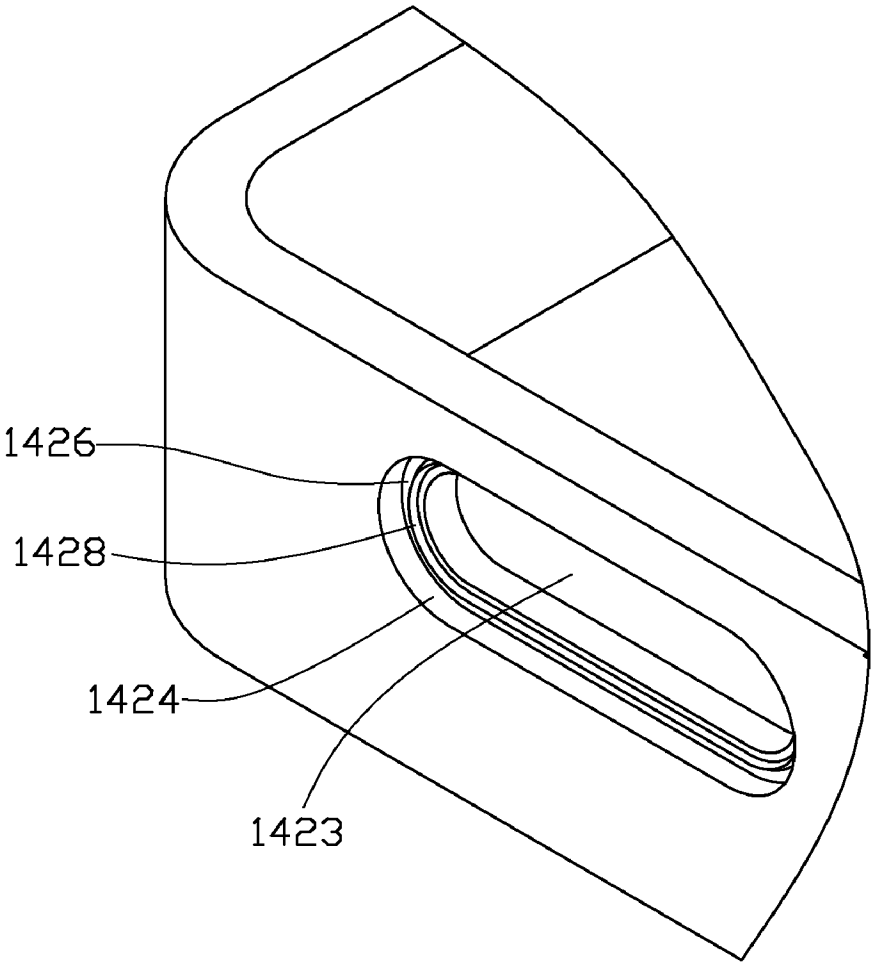
FIG. 4 is partially enlarged view of the portable electronic device shown in FIG. 3.

The second wall 1242 is for attaching the key body 124 to the housing 14. Referring to FIG. 3, the key body 124 has a mating portion 1245 in the form of a mating slot formed on the second wall 1242 and surrounding the through aperture 1243. The mating portion 1245 is exemplified by a mating slot in the present embodiment, and the cross section of the mating slot is triangle in shape. The peripheral wall 142 of housing 14 has a key hole 1423 defined therethrough. The contact(s) 1226 can enter the housing through the key hole 1423. Referring to FIG. 4, the housing 14 has a second groove 1424 defined in the outside wall 1422 and having a bottom surface 1426 formed on the housing 14. The second groove 1424 surrounds the key hole 1423. The second groove 1424 has substantially the same size and shape as that of the key body 124 for receiving the key body 124 therein. A joining portion 1428 protrudes from the bottom surface 1426. The joining portion 1428 is a rib surrounding the key hole 1423. The joining portion 1428 has substantially the same size and shape as that of the mating portion 1425, and the joining portion 1428 mates with the mating portion 1245.

Referring to FIGS. 5 and 6, during assembling the key button structure 10, the key cap 122 is adhered (e.g., by a glue) within the first groove 1244 of the key body 124, and the contact 1226 of the key cap 122 penetrate through the through aperture 1243 of the key body 124. Then the key body 124 is received in the second groove 1424, and the joining portion 1428 mates with the mating portion 1425. The joining portion 1428 is welded with the mating portion 1425 via ultrasound welding, thus the key body 124 is assembled with the housing 14 (i.e., the key button structure 10 is assembled with the housing.) In use, since the key button structure 10 is welded with the housing 14, the housing 14 and the key button structure 10 are tightly sealed together without a gap, thereby preventing water and/or dust from entering into the interior space of the portable electronic device 100. As a result, the portable electronic device 100 of the present embodiment is waterproof and dustproof.

It is to be understood that the key cap 122 may be integrally molded with the key body 124.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A key button structure comprising:

a housing having a key hole defined therethrough and a rib formed on an outer wall of the housing, the rib surrounding the key hole; and a key body having a mating slot corresponding to the rib, the mating slot accommodating the rib therein, the key body positioned in the key hole;

wherein the key button structure further includes a key cap, the key body having a through hole defined therethrough, the key body having a first wall facing to the key cap and a first disposing groove defined on the first wall, the first groove surrounding the through hole, the key cap being received in the first groove; the housing has a second groove defined on the outer wall, the second groove surrounding the key hole and communicating with the key hole.

2. The key button structure as claimed in claim 1, wherein a cross section of the mating slot is a triangle in shape.

3. The key button structure as claimed in claim 1, wherein the key body includes a second wall, the mating slot formed on the second wall.

4. The key button structure as claimed in claim 1, wherein the rib is formed on a bottom surface of the second groove.

5. The key button structure as claimed in claim 1, wherein the key cap is made of an elastic material.

6. The key button structure as claimed in claim 1, wherein the key cap is adhered to the key body.

7. The key button structure as claimed in claim 1, wherein the rib is welded to the mating slot.

8. The key button structure as claimed in claim 1, wherein the key cap has a front surface and a rear surface, a push portion formed on the front surface, a contact protruding from the rear surface, the contact entering into the housing from the key hole.

9. A portable electronic device comprising:

a key button structure, comprising:

a housing having a key hole defined therethrough and a rib formed on an outer wall of the housing, the rib surrounding the key hole; and a key body having a mating slot formed thereon corresponding with the rib, the mating slot accommodating the rib therein, the key button structure positioned in the key hole;

a circuit board assembled within the housing;

the key button structure used to be press a contact on the circuit board;

wherein the key button structure further includes a key cap, the key body having a through hole defined therethrough, the key body having a first wall facing to the key cap and a first groove defined on the first wall, the first groove surrounding the through hole, the key cap received in the first groove; the housing has a second groove defined on the outer wall, the second groove surrounding the key hole and communicating with the key hole.

10. The portable electronic device as claimed in claim 9, wherein the cross section of the mating slot is a triangle in shape.

11. The portable electronic device as claimed in claim 9, wherein the key body has a second wall, the mating slot formed on the second wall.

12. The portable electronic device as claimed in claim 9, wherein the rib is formed on the bottom surface of the second groove.

13. A portable electronic device comprising:

a housing having a key hole defined therethrough and a rib formed on an outer wall of the housing, the rib surrounding the key hole; and a key body having a mating slot formed thereon corresponding with the rib, the mating slot accommodating the rib therein to seal a gap between the housing and the key body, the key button structure positioned in the key hole;

wherein the key button structure further includes a key cap, the key body having a through hole defined therethrough, the key body having a first wall facing to the key cap and a first groove defined on the first wall, the first groove surrounding the through hole, the key cap received in the first groove; the housing has a second groove defined on the outer wall, the second groove surrounding the key hole and communicating with the key hole.

14. The portable electronic device as claimed in claim 13, wherein the rib is welded in the mating slot via ultrasound welding.

* * * * *